US008020738B2

(12) United States Patent
Storey

(10) Patent No.: US 8,020,738 B2
(45) Date of Patent: Sep. 20, 2011

(54) HARNESS FOR USE WITH BREATHING APPARATUS

(75) Inventor: David Graham Storey, Newcastle upon Tyne (GB)

(73) Assignee: Draeger Safety UK Limited, Blyth (GB)

( * ) Notice: Subject to any disclaimer, the term of this patent is extended or adjusted under 35 U.S.C. 154(b) by 287 days.

(21) Appl. No.: 11/946,570

(22) Filed: Nov. 28, 2007

(65) Prior Publication Data

US 2008/0179367 A1 Jul. 31, 2008

(30) Foreign Application Priority Data

Nov. 28, 2006 (GB) ..... 0623719.2

(51) Int. Cl.
*A45F 3/04* (2006.01)

(52) U.S. Cl. ..... 224/634; 224/635; 224/637; 224/641; 224/272; 224/148.7

(58) Field of Classification Search ..... 224/634, 224/635, 637, 641, 263, 272, 604, 197, 148.7
See application file for complete search history.

(56) References Cited

U.S. PATENT DOCUMENTS

| | | | | |
|---|---|---|---|---|
| 2,197,427 | A * | 4/1940 | Despain | 224/635 |
| 2,557,313 | A * | 6/1951 | Quilter | 297/478 |
| 3,090,621 | A * | 5/1963 | Heimers et al. | 224/262 |
| 4,676,418 | A * | 6/1987 | Lowe | 224/638 |
| 5,427,290 | A * | 6/1995 | Thatcher | 224/148.2 |
| 6,070,776 | A * | 6/2000 | Furnary et al. | 224/627 |
| 6,290,111 | B1 | 9/2001 | Hedenberg et al. | |
| 6,637,631 | B2 * | 10/2003 | Lafoux et al. | 224/197 |
| 2006/0131355 | A1 * | 6/2006 | Tate | 224/637 |
| 2006/0289589 | A1 * | 12/2006 | Gregory | 224/631 |
| 2007/0090137 | A1 * | 4/2007 | Kim | 224/153 |
| 2008/0197163 | A1 * | 8/2008 | Yip | 224/635 |
| 2009/0127301 | A1 * | 5/2009 | Fidrych et al. | 224/197 |

* cited by examiner

*Primary Examiner* — Nathan J Newhouse
*Assistant Examiner* — John Cogill
(74) *Attorney, Agent, or Firm* — DLA Piper LLP (US)

(57) ABSTRACT

A harness (10) for use with breathing apparatus comprises: a back plate (11); two support straps (13, 14), each of which extends between an upper part of the back plate and a lower part of the back plate, the two support straps being disposed on opposite sides of a central axis of the back plate (11); and a tension equalizing mechanism (15, 16; 30, 32) connected to the support straps and being arranged such that, when tension is applied to a first strap (13, 14) of the support straps, it acts to transfer the tension to the other, second strap (13, 14), thereby increasing the tension in the second strap, the tension equalizing mechanism being resiliently biased towards a neutral configuration.

15 Claims, 5 Drawing Sheets

HARNESS FOR USE WITH BREATHING APPARATUS

CROSS REFERENCE TO RELATED APPLICATION

This is a utility application based upon United Kingdom Application No. 0623719.2 filed Nov. 28, 2006 entitled Automatic Shoulder-Strap Tensioning System for which priority is claimed.

BACKGROUND OF THE INVENTION

The invention relates to a harness for use with breathing apparatus. In particular, the invention relates to a harness of the type worn by professional fire-fighters, though it may be applied to other sorts of harness, such as a diving harness, also.

A known harness 1 for use with breathing apparatus is shown in FIG. 1. The harness includes a back plate 2, a waist belt 3, shoulder straps 4 and shoulder pads 5. A gas cylinder 6 containing pressurized gas is mounted to the back plate 2. The weight of the harness and cylinder is transferred to the hips of the user through the waist belt 3 and to the upper body of the user through the shoulder pads 5 and shoulder straps 4.

In this regard, each shoulder strap 4 is attached in two places. Namely, at a first end to one of the shoulder pads 5 and at a second end to the lower part of the back plate 2. Each strap thus forms a loop, which takes some of the weight of the harness/cylinder unit and helps to hug the harness to the wearer's body.

The constant tension on the shoulders from the shoulder straps 4 makes wearing the harness 1 noticeable and can cause fatigue. In addition, when the wearer lifts an arm into the air, the shoulder strap 4 goes into tension, restricting movement and causing the associated shoulder pad 5 to dig into the wearer's shoulder. This is a particular problem when climbing ladders, reaching for high objects or crawling.

Furthermore, when the wearer is crawling one shoulder drops as the other arm is stretched out and this can cause tension in the strap 4 on the shoulder which drops to be completely removed. The shoulder strap and associated pad 5 can therefore fall off the shoulder making the unit unstable.

A known harness designed to alleviate the above problems is described in U.S. Pat. No. 6,290,111. In this harness, the shoulder straps are attached to opposite sides of a rigid element provided at the lower part of the back plate. The rigid element is pivotally connected to the back plate at a central point between where the shoulder straps are attached. Thus, when the wearer raises one arm the tension in the associated shoulder strap causes the rigid element to rotate about the central point, helping to reduce the tension in the strap. Furthermore, rotation of the rigid element causes tension to be applied to the other shoulder strap, helping to prevent the tension in that shoulder strap from being removed. However, the above harness allows only a limited degree of movement in which tension in the straps is accommodated, and tension is not always maintained in both straps which can make the harness unstable.

It is therefore desirable to provide a harness which enables the wearer to perform a fuller range of movement, in comfort, and which prevents the harness from becoming unstable.

According to the present invention, there is provided a harness for use with breathing apparatus, comprising: a back plate; two support straps, each of which extends between an upper part of the back plate and a lower part of the back plate, the two support straps being disposed on opposite sides of a central axis of the back plate; and a tension equalizing mechanism connected to the support straps and being arranged such that, when tension is applied to a first strap of the support straps, it acts to transfer the tension to the other, second strap, thereby increasing the tension in the second strap, the tension equalizing mechanism being resiliently biased towards a neutral configuration.

The resilient biasing of the tension equalizing mechanism towards the neutral configuration ensures that the support straps move with the body and remain tense. In this way, the harness is prevented from becoming unstable.

Preferably, the tension equalizing mechanism is arranged such that, when tension is no longer applied to the first strap, it acts to increase the tension in the first strap by decreasing the tension in the second strap and transferring the tension to the first strap.

Thus, the support straps are stopped from going slack and are always kept under tension, ensuring that the straps do not come off the user's shoulder during use of the harness.

Preferably, the tension equalizing mechanism includes first and second tension accommodating means connected by a connecting element, wherein, when tension is applied to the first support strap, the first tension accommodating means acts to increase an effective length of the first support strap and to reduce the tension in the strap, and the tension is transferred via the connecting element to the second tension accommodating means, which acts to reduce an effective length of the second support strap and to increase the tension in the second support strap.

The independent action of each of the first and second tension accommodating means on the first and second support straps, together with the connection therebetween, enables the wearer to perform a fuller range of movement and in greater comfort than previously possible. In addition, it ensures that the harness is stable when the user is crawling.

By enabling the wearer to move more freely and with less restriction, the harness advantageously allows the wearer to concentrate on the task at hand without having to worry about pain and stress caused by carrying the weight of the cylinder in an uncomfortable manner.

Preferably, first biasing means for urging the first attachment means to a central return position and/or second biasing means for urging the second attachment means to a central return position are provided, so as to resiliently bias the tension equalizing mechanism towards the neutral configuration. The biasing means may include an elastic return part such as a rubber return part or a spring.

Advantageously, the biasing means provide a small, controlled resistance to the movement of the wearer, making the adjustment of the shoulder straps feel more natural and secure to the wearer and ensuring that adequate tension is always provided in the straps.

BRIEF DESCRIPTION OF THE DRAWING

Reference is now made, by way of example only, to the accompanying drawings, in which.

DESCRIPTION OF AN EMBODIMENT

Figure 1:
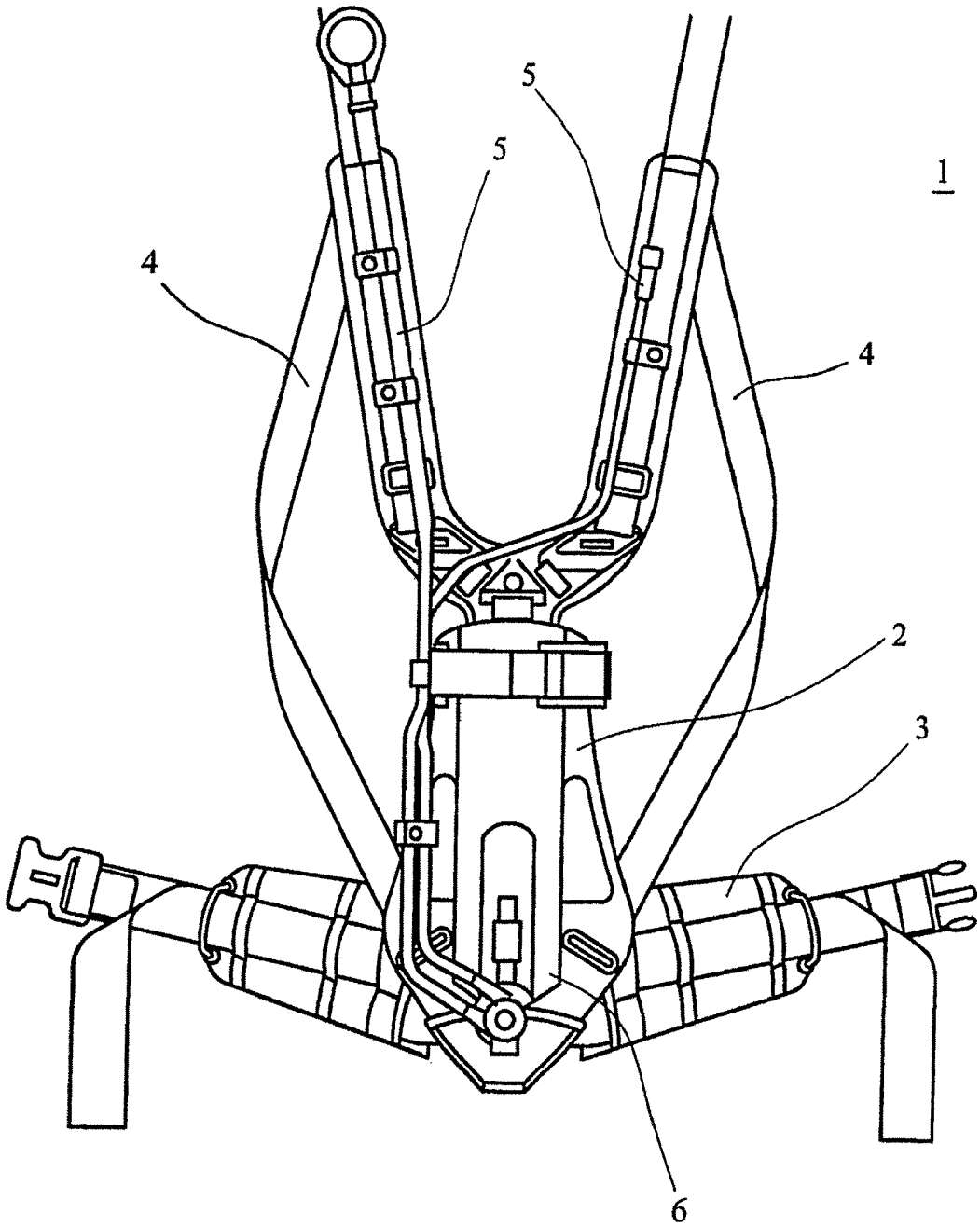
FIG. 1 shows a known harness.
Figure 2:
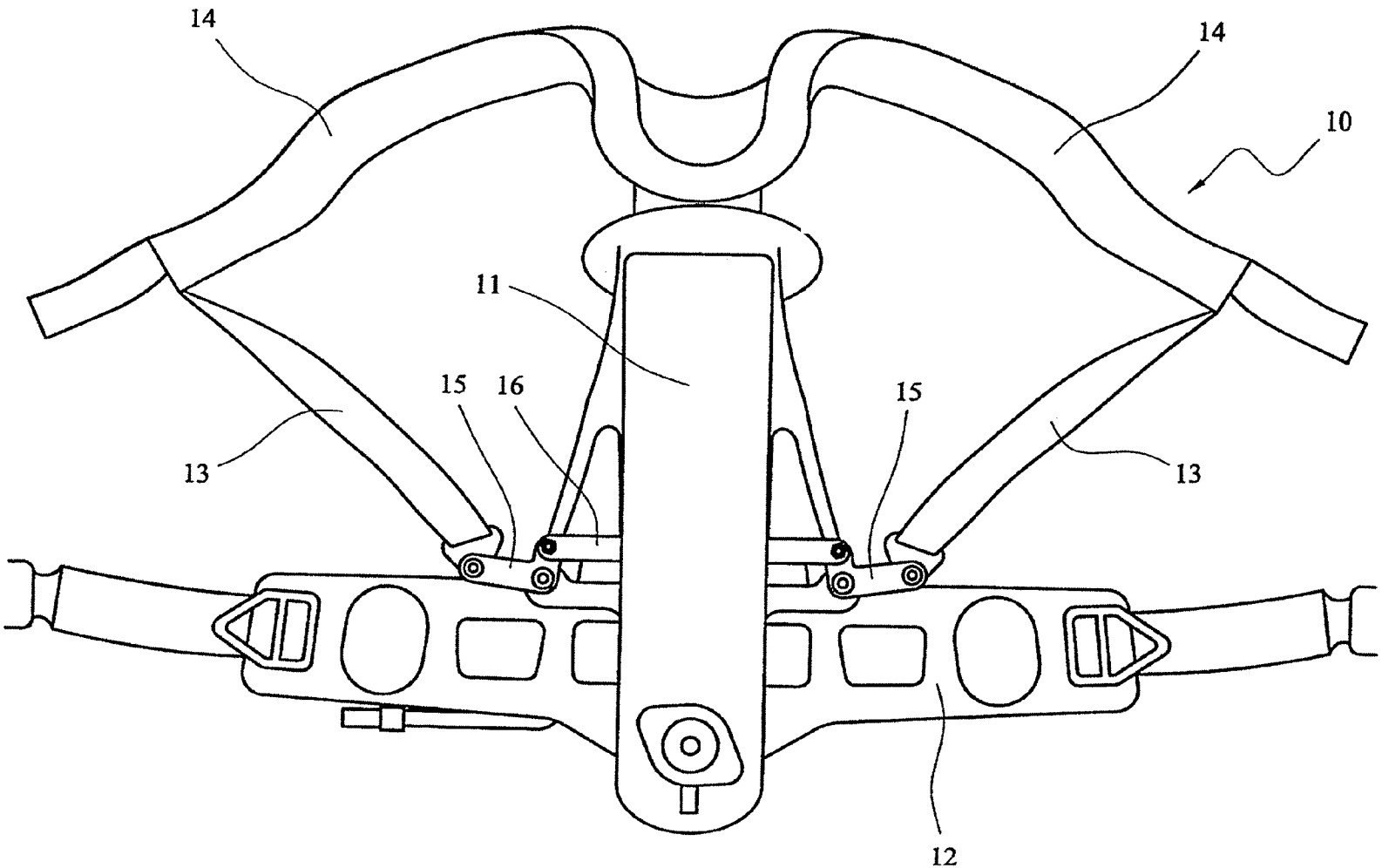
FIG. 2 shows a harness according to an embodiment of the invention.

FIG. 2 shows a rear view of a harness 10 according to an embodiment of the invention. The harness 10 includes a back plate 11, a waist belt 12, shoulder straps 13 and shoulder pads 14. Each shoulder strap 13 is attached to a respective one of the shoulder pads 14 at a first end, with each of the shoulder pads 14 being attached to an upper part of the back plate 11. At a second end, each shoulder strap 13 is attached to a lower part of the back plate via a respective tension accommodating means 15 of a tension equalizing mechanism. Each tension accommodating means lies substantially in the plane of the back plate. The tension accommodating means 15 are linked by a link rod 16, which floats freely between the two tension accommodating means. The link rod 16 may pass through a groove or recess 21 in the back plate, as can be seen in FIG. 3.

Figure 3:
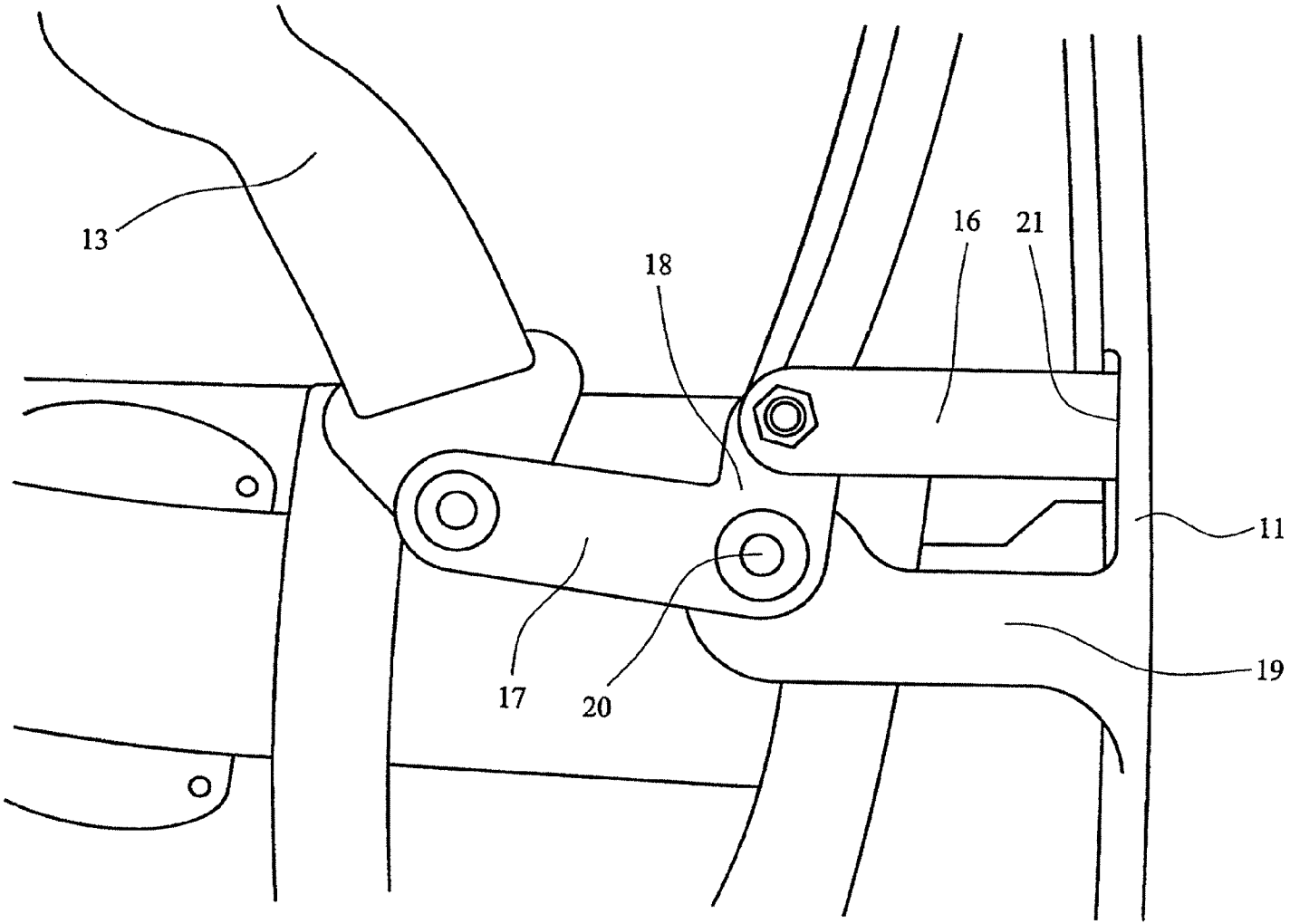
FIG. 3 shows a portion of the harness of FIG. 2.

One of the tension accommodating means is shown in greater detail in FIG. 3. As can be seen, the tension accommodating means comprises an L-shaped member having first and second arms 17, 18. The first arm 17 is disposed substantially perpendicular to the second arm 18. The shoulder strap 13 is connected to an end region of the first arm 17 and the link rod is connected to an end region of the second arm 18. The L-shaped member is pivotally connected to a part 19 of the back plate 11 at pivot point 20, which is positioned between its first and second arms. The L-shaped member can therefore rotate about the axis of the pivot (perpendicular to the plane of the back plate).

Thus, when a wearer lifts his left arm (the shoulder strap shown in FIG. 3 being for the wearer's left side), the shoulder strap 13 is put under tension. The shoulder strap 13 in turn exerts a force on the pivot arm 17 urging the pivot arm upwards. Hence, the end region of the pivot arm 17 to which the strap 13 is attached is caused to move upwards and the L-shaped member rotates about the pivot point 20 accordingly. In this way, the wearer is able to lift his arm freely because the increased tension in the shoulder strap 13 is accommodated (relieved) by the upward movement of the pivot arm 17, effectively lengthening the shoulder strap 13.

Furthermore, the resultant clockwise rotation of the L-shaped member causes the end region of the arm 18 to which the link rod 16 is connected to move downwards and rightwards towards the back plate 11. As the link rod 16 moves in this fashion, the tension in the shoulder strap 13 from the lifting of the wearer's left arm is transferred to the shoulder strap 13 on the wearer's right-hand side.

In other words, as can be seen from FIG. 2, the movement of the link rod 16 downwards and to the right causes the L-shaped tension accommodating means 15 on the other side of the back plate to undergo a clockwise rotation about its pivot point 20. This rotation causes the end of the pivot arm 17 of the L-shaped member to which the shoulder strap 13 is connected to move downwards, shortening an effective length of the shoulder strap and thus increasing the tension in the shoulder strap 13 and pulling the associated shoulder pad 14 more firmly against the wearer's right shoulder. In this way, tension in the left shoulder strap is transferred to the right shoulder strap. Of course, the same occurs in reverse if the wearer lifts his right arm instead of his left arm. Hence, as the shoulder strap on one side of the harness effectively lengthens to reduce the tension caused by the wearer raising his arm on that side, the other shoulder strap effectively shortens to increase the tension on the other, dropped shoulder, due to the mirror-image arrangement of the tension accommodating means 15.

Thus, the wearer is able to lift his arms freely without hindrance from the harness, and is able to crawl without risk of either shoulder strap 13 falling off as his shoulders drop, because of the manner in which the tension in one shoulder strap 13 is transferred to the other shoulder strap.

Figure 4:
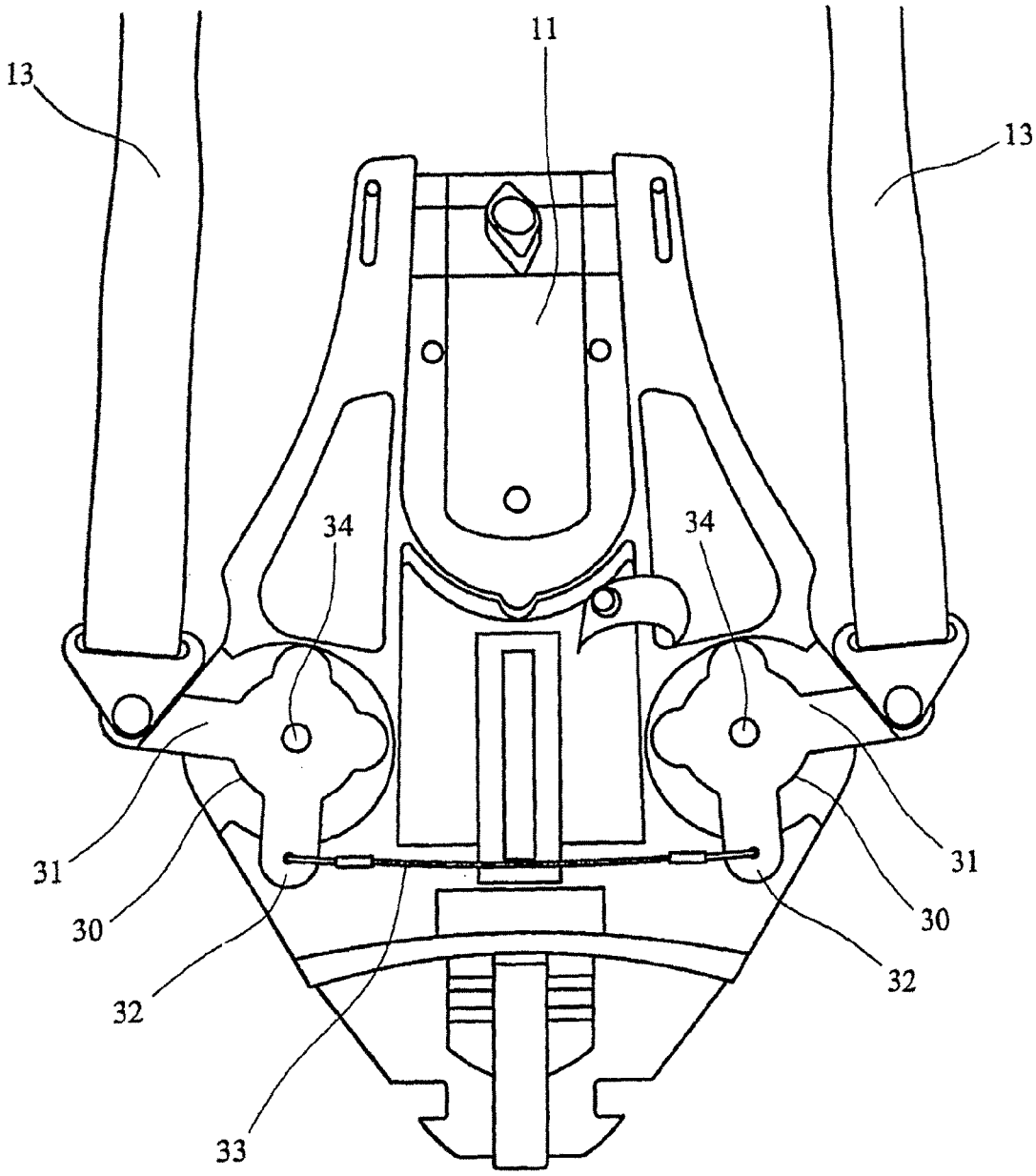
FIG. 4 shows a portion of a harness according to another embodiment of the invention.

FIG. 4 shows a portion of a harness according to another embodiment of the invention, namely the back plate 11 and shoulder straps 13 of the harness. In the figure, the shoulder straps 13 are not connected to the upper part of the back plate 10 via shoulder pads 14, though of course they would be in the fully assembled harness.

In this embodiment, each tension accommodating means 30 is a pulley having first and second arms 31 and 32 disposed substantially at a right-angle with respect to one another. Each first arm 31 is connected to a respective shoulder strap 13 and each second arm 32 is connected to a common wire 33, which acts as a connecting element between the tension accommodating means 30. In addition, each tension accommodating means is pivotally connected to the back plate 11 about a respective pivot point 34, which is provided between the first and second arms of the tension accommodating means.

The embodiment of FIG. 4 thus functions in a similar way to that of FIGS. 2 and 3 described above. Namely, tension in one of the shoulder straps 13 causes the pivot arm 31 to which it is connected to be raised upwards, thus rotating the tension accommodating means 30 about its pivot point 34. For example, the tension accommodating means 30 shown on the right of the figure will rotate anti-clockwise if tension is applied to its shoulder strap 13. This rotation effectively lengthens the shoulder strap 13 and enables the tension in the shoulder strap to be reduced, enabling the wearer to move freely.

In addition, this rotation causes the arm 32 to rotate anti-clockwise also, which in turn pulls on the wire 33. The wire 33 is therefore put under tension and transfers the force (tension) to the tension accommodating means 30 on the left of the figure, rotating it in the anti-clockwise direction also. As this tension accommodating means rotates, the shoulder strap 13 to which it is connected is pulled downwards, pulling the shoulder pad 14 more firmly against the wearer's shoulder on that side. In other words, tension is transferred from one of the shoulder straps to the other shoulder strap. Of course, the same happens in reverse if tension is applied to the other shoulder strap initially.

Figure 5:
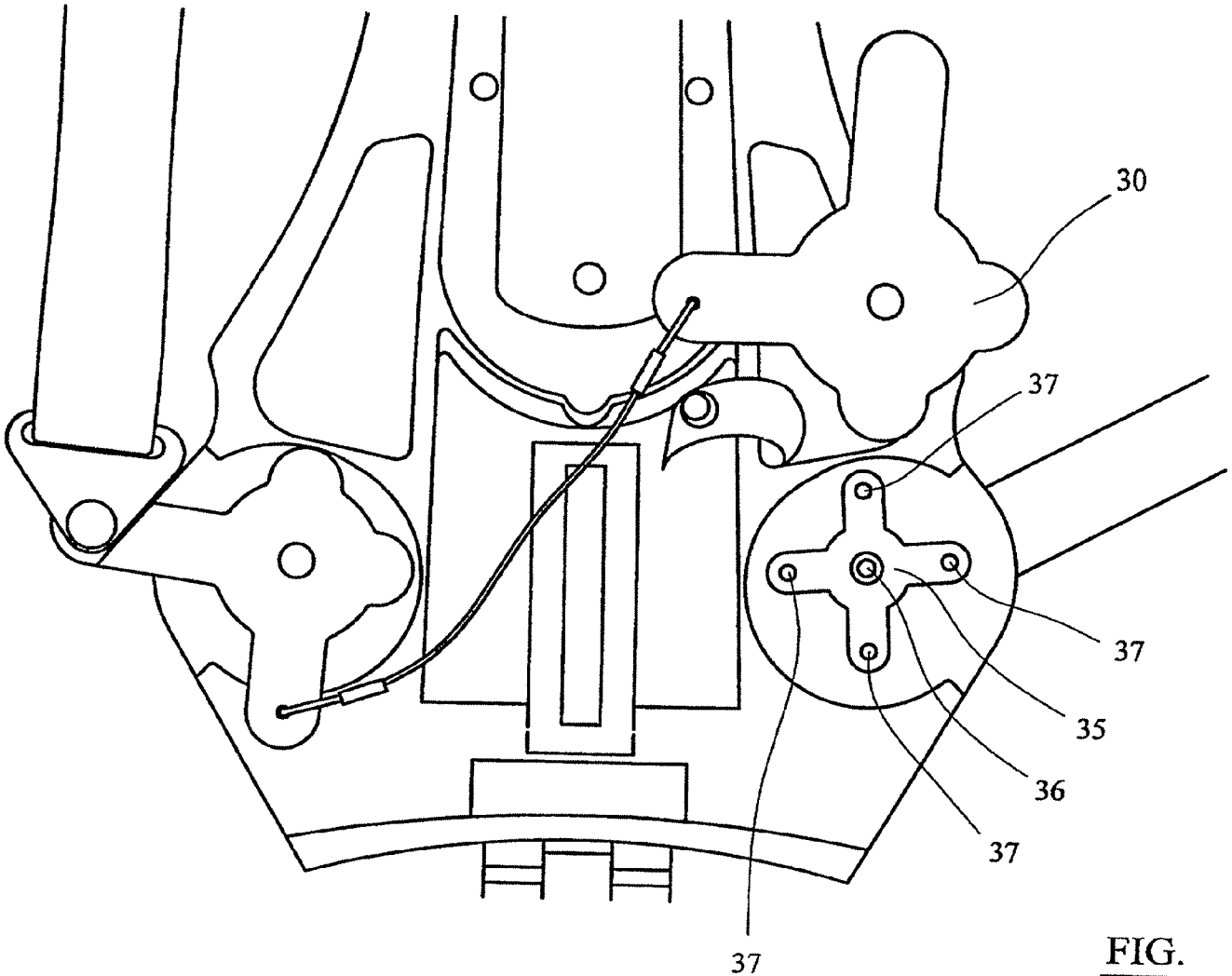
FIG. 5 shows a return device as a biasing means in one of the attachment means shown in FIG. 4.

FIG. 5 shows a return device 35 as a biasing means in one of the tension accommodating means 30 shown in FIG. 4. The return device has elastic properties and has a central hole through which a pivot pin 36 of the pivot point 34 passes, together with outer holes 37 on each of four arm regions. The outer holes 37 engage with corresponding protrusions on the underside of the tension accommodating means 30.

The return device 35 acts to bias the tension accommodating means 30 towards a central return (neutral, rest) position. When the tension accommodating means rotates, due to tension in the shoulder strap 13 or from the wire 33, it causes the arms of the return device to move also, through the engagement of its protrusions with the holes 37. When tension is no longer applied to the shoulder strap 13 or wire 33 and the tension accommodating means is thus not caused to rotate further, the return device 35 acts to return the tension accommodating means to its original position. This occurs as the elastic arms of the return device seek to return to their original, un-deformed configuration.

A biasing means could be provided for the harness of the embodiment of FIGS. 2 and 3 also. In addition, the biasing means need not be a return part of the type described above. Any part having suitable elastic properties could be used, such as a spring (e.g. coil spring). A spring could, for example, be attached between a part of the L-shaped member, such as one of the arms, and a portion of the back plate.

It is preferable that the tension accommodating means are disposed symmetrically about a central longitudinal axis of the back plate. In this way, a smooth and even adjustment of the shoulder straps is realized.

As described above, a harness embodying the invention enables free independent movement of the wearer's arms and shoulders and transfers tension effectively from one shoulder strap to the other. When the wearer is climbing a ladder or crawling, the shoulder straps tighten and loosen alternately in synchronism with the user's movement, as the tension equalizing mechanism is resiliently biased in a neutral configuration.

What is claimed is:

1. A harness for use with breathing apparatus, comprising a back plate;

two support straps, each of which extends between an upper part of the back plate and a lower part of the back plate, the two support straps being disposed on opposite sides of a central axis of the back plate; and a tension equalizing mechanism connected to the support straps and being arranged such that, when tension is applied to a first strap of the support straps, it acts to transfer the tension to the other, second strap, thereby increasing the tension in the second strap, wherein the tension equalizing mechanism comprises a tension accommodating member rotatably mounted to the back plate, and a biasing means that rotationally resiliently biases the tension accommodating member in a rotational direction such that the support straps are resiliently biased towards a neutral configuration;

wherein the tension equalizing mechanism includes first and second tension accommodating members connected by a connecting element, wherein, when tension is applied to the first support strap, the first tension accommodating member acts to increase an effective length of the first support strap and to reduce the tension in the strap, and the tension is transferred via the connecting element to the second tension accommodating member, which acts to reduce an effective length of the second support strap and to increase the tension in the second support strap, wherein the first and second tension accommodating members are axially and rotatably mounted to the back plate about first and second rotational axis, respectively, and act to reduce or increase the tension in the first or second support straps by rotation about the first and second rotational axis, respectively.

2. A harness according to claim 1, further comprising first biasing means for urging the first tension accommodating member to a central return position and/or second biasing means for urging the second tension accommodating member to a central return position, so as to resiliently bias the tension equalizing mechanism towards the neutral configuration.

3. A harness according to claim 2, wherein the first or second biasing means comprises an elastic return device attached to the first or second tension accommodating member, respectively.

4. A harness according to claim 3, wherein the elastic return device comprises rubber.

5. A harness according to claim 2, wherein the first or second biasing means comprises a spring connected to the first or second tension accommodating member, respectively.

6. A harness according to claim 1, wherein each tension accommodating member has a first arm to which its respective support strap is connected and a second arm to which the connecting element is connected, the tension accommodating member being axially mounted to the back plate about a pivot point between the first and second arms.

7. A harness according to claim 6, wherein the first arm is substantially perpendicular to the second arm.

8. A harness according to claim 1, wherein the tension equalizing mechanism is arranged such that, when tension is no longer applied to the first strap, it acts to increase the tension in the first strap by decreasing the tension in the second strap and transferring the tension to the first strap.

9. A harness according to claim 1, wherein the first and second tension accommodating members are connected to the first and second support straps, respectively.

10. A harness according to claim 1, wherein the first tension accommodating member and the second tension accommodating member are disposed symmetrically with respect to the central axis of the back plate.

11. A harness according to claim 1, wherein the first and second tension accommodating members are provided substantially in the plane of the back plate.

12. A harness according to claim 1, wherein the first tension accommodating member, the second tension accommodating member and the connecting element are formed integrally.

13. A harness according to claim 1, wherein the connecting element comprises a rod or bar.

14. A harness according to claim 1, wherein the connecting element comprises a wire.

15. A harness according to claim 1, wherein each of the first and second support straps comprises a shoulder pad connected to the upper part of the back plate and a shoulder strap connected to the lower part of the back plate.

* * * * *